US009694331B2

(12) United States Patent
Seiler et al.

(10) Patent No.: US 9,694,331 B2
(45) Date of Patent: Jul. 4, 2017

(54) MIXER HAVING ROTATING MIXING CONTAINER

(75) Inventors: Andreas Seiler, Tauberbischofsheim (DE); Wolfgang Worner, Hopfingen-Waldstetten (DE)

(73) Assignee: MASCHINENFABRIK GUSTAV EIRICH GMBH & CO. KG, Hardheim (DE)

( * ) Notice: Subject to any disclaimer, the term of this patent is extended or adjusted under 35 U.S.C. 154(b) by 872 days.

(21) Appl. No.: 13/140,472

(22) PCT Filed: Dec. 4, 2009

(86) PCT No.: PCT/EP2009/066458

§ 371 (c)(1),
(2), (4) Date: Jun. 17, 2011

(87) PCT Pub. No.: WO2010/076120

PCT Pub. Date: Jul. 8, 2010

(65) Prior Publication Data

US 2011/0249527 A1 Oct. 13, 2011

(30) Foreign Application Priority Data

Dec. 17, 2008 (DE) ..... 10 2008 054 842

(51) Int. Cl.

| | |
|---|---|
| ***B01F 9/12*** | (2006.01) |
| ***B22C 5/04*** | (2006.01) |
| *B01F 15/00* | (2006.01) |

(52) U.S. Cl.

CPC ..... *B01F 9/12* (2013.01); *B22C 5/0454* (2013.01); *B01F 2015/0059* (2013.01); *B01F 2015/00084* (2013.01); *B01F 2015/00603* (2013.01)

(58) Field of Classification Search

CPC ..... B01F 9/12

(Continued)

(56) References Cited

U.S. PATENT DOCUMENTS 1,351,243 A * 8/1920 Craves ..... 366/251
1,435,289 A * 11/1922 Gilbert ..... 366/248

(Continued)

FOREIGN PATENT DOCUMENTS

CN 2055406 U 4/1990
CN 2541036 Y 3/2003

(Continued)

OTHER PUBLICATIONS

People's Republic of China Search Report, Application No. 200980151667.9, Dated 2013, English Translation.
Taiwan Patent Office, Office Action, Application No. TW 098139323, Dated 2015, and English Translation.

*Primary Examiner* — Abbas Rashid
(74) *Attorney, Agent, or Firm* — Paul & Paul

(57) ABSTRACT

The present invention relates to a mixer with a mixing container and a tool shaft (8) which is arranged at least partly in the mixing container and has a drive end and a working end for a working tool (6), the tool shaft (8) being mounted on the drive end by means of two mutually set-apart tool bearings and a drive motor (7) being provided for the tool shaft (8). In order to provide a mixer which is simple and economical to manufacture and has as few movable and wearing parts as possible and the tool shaft (8) of which is, in addition, able to accommodate the considerable transverse forces occurring during operation, the invention proposes that the drive motor (7) have a motor shaft which is mounted, at least on one side, by a tool bearing.

19 Claims, 3 Drawing Sheets

(58) Field of Classification Search
USPC ..... 366/249, 251, 331
See application file for complete search history.

(56) References Cited

U.S. PATENT DOCUMENTS

| | | | | | |
|---|---|---|---|---|---|
| 1,718,745 | A | * | 6/1929 | Laing | 366/251 |
| 1,783,651 | A | * | 12/1930 | Johnson | 366/207 |
| 1,935,857 | A | * | 11/1933 | Nachumsohn | 366/251 |
| 2,008,684 | A | * | 7/1935 | Craddock | 366/249 |
| 2,250,838 | A | * | 7/1941 | Nester | 366/249 |
| 3,140,861 | A | * | 7/1964 | Krup | 366/156.1 |
| 4,159,879 | A | * | 7/1979 | Coucher | 366/98 |
| 4,854,715 | A | | 8/1989 | Eirich et al. | |
| 5,813,758 | A | * | 9/1998 | Delcourt et al. | 366/171.1 |
| 6,435,262 | B1 | | 8/2002 | McVane | |
| 6,698,934 | B2 | | 3/2004 | Harclerode | |
| 7,913,878 | B1 | * | 3/2011 | Baron et al. | 222/129.1 |
| 2004/0120215 | A1 | * | 6/2004 | Huang et al. | 366/203 |
| 2009/0208160 | A1 | * | 8/2009 | Wolf | 384/477 |

FOREIGN PATENT DOCUMENTS

| | | | |
|---|---|---|---|
| CN | 201050598 | Y | 4/2008 |
| DE | 1301874 | B | 8/1969 |
| DE | 2323579 | B1 | 6/1974 |
| DE | 3520409 | A1 | 12/1986 |
| DE | 3942679 | A1 | 6/1991 |
| DE | 19712324 | C2 | 1/1998 |
| DE | 19749223 | A1 | 5/1999 |
| DE | 60015482 | T2 | 10/2005 |
| GB | 330834 | A | 6/1930 |
| JP | 05-293349 | A | 11/1993 |
| JP | 2004-073953 | A | 3/2004 |
| JP | 2004-121989 | A | 4/2004 |
| JP | 2006-305413 | A | 10/2006 |
| JP | 2007-247849 | A | 9/2007 |
| WO | 03093677 | A1 | 11/2003 |
| WO | 2008151874 | A | 12/2008 |
| WO | 2010015496 | A | 2/2010 |

* cited by examiner

MIXER HAVING ROTATING MIXING CONTAINER

The present invention relates to a mixer with a mixing container and a tool shaft arranged at least partly in the mixing container, the tool shaft having a working end to which a working tool is fastened or can be fastened and a drive end which is mounted by means of two mutually set-apart tool bearings, and a drive motor being provided with a motor shaft for driving the tool shaft.

A mixer of this type is for example known from DE 35 20 409. The embodiment disclosed therein comprises a pressure-resistant mixer with a filling opening, a rotating mixing container having an emptying means, with mixing tools arranged eccentrically to the mixing container axis inside the mixing container.

The mixer known in the art is represented schematically in FIG. 1 which is a vertical section through a mixer. The mixer 1 has a mixing container 3 which is received in a mixer housing 2 and can be rotated about a vertical axis of rotation. In order to ensure this rotation, the mixing container 3 is rotatably mounted on a ball bearing 4. The mixing container can have an emptying opening (not shown in the figure) at its underside. The mixer housing 2 has a housing cover 5. A working tool 6, which is embodied as a mixing tool, is arranged inside the mixing container 3. It may be seen that the working tool 6 is rotatable about a vertical axis which is set apart from the axis of rotation of the mixing container 3. For this purpose, a drive end of the working tool 6 is guided through the housing cover 5 and driven with the aid of the drive motor 7 via, for example, V-belts 9.

The working tools 6 are fastened to a tool shaft 8 which has a drive end on which the V-belt 9 acts and a working end to which the working tools 6, which are embodied as the mixing tool, are fastened. The tool shaft 8 is in the embodiment shown formed in two parts, wherein the two parts can be joined together or separated from each other via the flange connection 10. This flange connection 10 is provided inter alia to exchange the working tool 6 for another working tool 6, such as for example a star vortexer for a pin vortexer. In addition, the working tool can, when it displays phenomena of wear, be exchanged for a new one. As both the mixing container 3 and the tool shaft 8 rotate, considerable transverse forces can act on the tool shaft 8, the transverse forces being caused by the flow of material through the rotating mixing container 3, especially as the tool shaft is held in the housing cover 5 only at one side. The magnitude of the transverse force depends inter alia on the nature of the material to be mixed and of course on the rotational speed of both the mixing container 3 and the working tool 6.

Two tool bearings 11, 12, which each mount the shaft having a diameter D, are therefore provided at the drive end for holding the tool shaft 8. In order to absorb the forces, the tool bearings 11, 12 are screwed to the mixer housing 2 or the housing cover 5 via a flange 13.

The V-belt 9 then acts on the drive end of the tool shaft 8. The drive motor 7 has a motor shaft 20 which is also held via two motor bearings 14, 15. It may be seen that the diameter d' of the motor shaft 20 is much smaller than the diameter D of the tool shaft 8.

In the prior art, the drive motor is mainly in the form of three-phase asynchronous motors or hydraulic motors with V-belt or toothed belt transmission, and also geared motors.

All these types of drive have in common the fact that a large number of elements are required for generating torque and for converting torque and also for accommodating the load. In the simplest case of the asynchronous motor with a corresponding bearing arrangement, at least four bearings are required—two bearings for the motor shaft and two bearings for the tool shaft—which have to accommodate, as well as the weight forces, in addition also the high forces from the working tool and also the considerable belt forces.

If a geared motor or a separate gear mechanism is used, at least two further bearings have to be provided for each further reduction stage.

In addition to the complex and yet failure-prone bearings, the belt transmission, consisting generally of a set of a plurality of V-belts or toothed belts, is a high-maintenance machine element. These components have to be checked at regular intervals for correct stress and the stress must, if appropriate, be adapted. Likewise, both V-belts and toothed belts are prone to wear and must therefore be exchanged at regular intervals.

Against the background of the described prior art, it is therefore the object of the present invention to provide a mixer which is simple and economical to manufacture and has torque which is as high as possible in a broad rotational speed range and a minimum number of wear-prone components for driving the working tool.

According to the invention, this object is achieved in that the motor shaft is mounted by at least one of the two mutually set-apart tool bearings.

In other words, one of the bearings, which is provided for mounting the tool shaft, is used at the same time for mounting the motor shaft. The motor shaft and tool shaft are therefore directly connected to each other. This measure allows at least one bearing to be avoided.

Particularly preferred is an embodiment in which the motor is arranged between the two tool bearings and the motor shaft is mounted preferably by means of the two tool bearings. This embodiment allows two bearings to be dispensed with, as the bearings for the tool shaft serve at the same time as bearings for the motor shaft. Basically, in this embodiment, it is no longer possible to distinguish between the motor shaft and tool shaft, as one portion of the shaft functions as the motor shaft and another portion of the same shaft functions as the tool shaft.

The motor used is in these cases preferably a direct drive and particularly preferably a three-phase synchronous motor (servo motor, torque motor, reluctance motor).

In a further preferred embodiment, the bearing of the motor shaft that faces the tool shaft is suitable for accommodating particularly high radial and axial forces. The bearing is designed preferably as a combined radial axial bearing (radiax bearing), for example as a self-aligning roller bearing or self-aligning ball bearing and particularly preferably a twin-row self-aligning roller bearing.

It has been found that, in particular, a twin-row self-aligning roller bearing can best accommodate the transverse forces occurring during operation.

A further preferred embodiment makes provision for the diameter of the motor shaft to differ on the two tool bearings, preferably the diameter of the motor shaft d" on the tool bearing remote from the tool shaft being smaller, preferably at least 30%, particularly preferably at least 50% smaller, than the diameter of the motor shaft D on the other tool bearing.

It has been found that merely the bearing facing the mixing container must have a large diameter. On suitable designing of the bearings, the bearing remote from the mixing container can be made much smaller and thus more economical.

The motor is expediently arranged in a motor housing, both tool bearings being arranged on or in the motor housing. In this case, the motor housing can have a first outer flange by which the motor housing, and thus the motor, is fastened to the mixer housing. Furthermore, in a particularly preferred embodiment, the motor housing can have a second outer flange which is also fastened to the mixer housing, the second outer flange having preferably a larger average diameter than the first outer flange.

The motor housing could have, for example, a circular cross section, the outer flange then expediently also having a circular cross section. However, in principle, other cross sections, for example square or rectangular cross sections, are also conceivable. The fact that the second outer flange has a larger average diameter means that the motor can easily be fastened to the mixer housing. For example, the mixer housing can have a stepped through-opening with a first portion having a smaller average diameter and a second portion having a larger average diameter, the second portion having an average diameter which is larger than the average diameter of the first outer flange and smaller than the average diameter of the second outer flange. In a preferred embodiment, the smallest average diameter of the stepped through-opening in the mixer housing is larger than the largest external diameter of the working tool. This measure allows the entire working tool, including the motor, to be removed via the stepped through-opening.

Typically, both flanges have holes for fastening the flanges to the mixer housing. In this case, the larger flange can have additional openings which are preferably larger than the holes for fastening and are provided to allow a tool to access the holes or fastening means in the smaller flange through the opening. This facilitates the fastening of the motor housing to the mixer housing.

In a further preferred embodiment, the tool shaft consists of two parts which are detachably fastened to each other, one part being integrally connected to the motor shaft, while the other part carries the working tool. In this case, the detachable connection can be carried out via a flange connection.

Alternatively thereto, the tool shaft can also be formed in one piece with the motor shaft.

Further advantages, features and possible applications of the present invention will become clear from the following description of preferred embodiments and also from the associated figures, in which:

FIG. 1 shows a prior art embodiment which has already been described at the outset.

Figure 1:
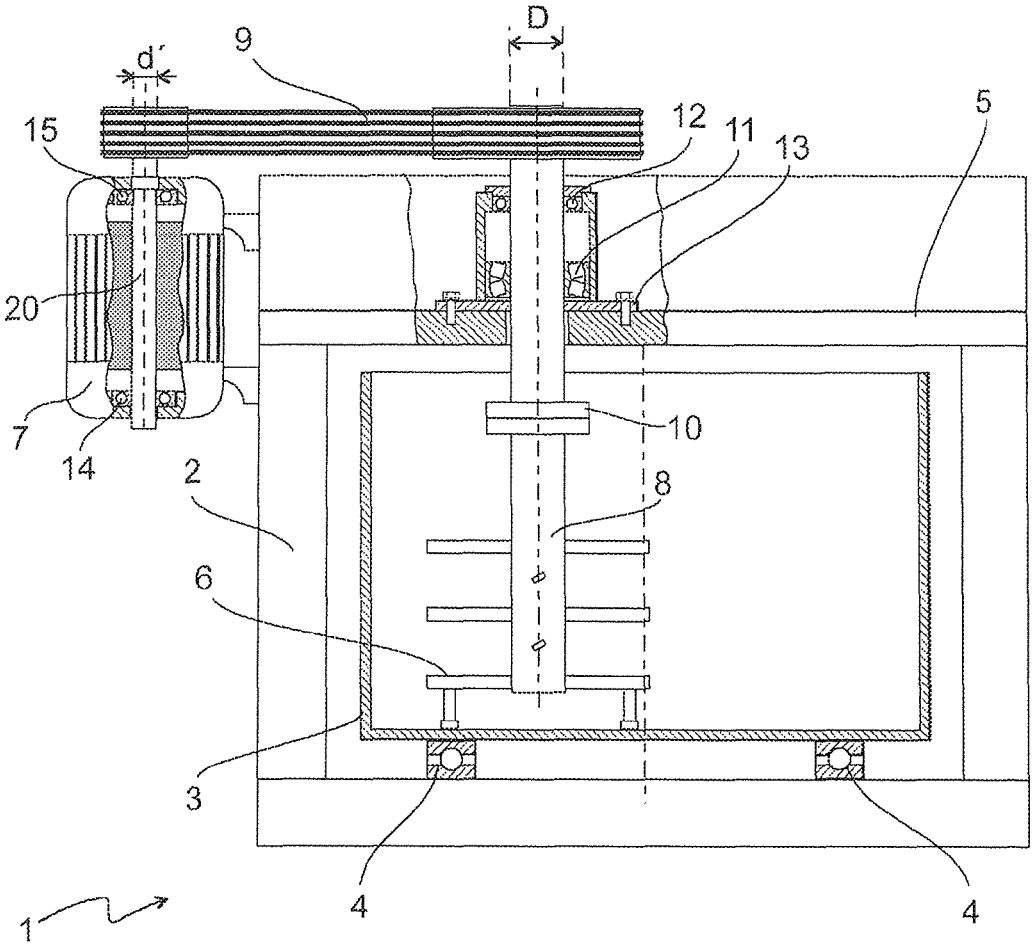
Fig. 1 Prior Art
FIG. 1 is a vertical section through a mixture of the prior art.
Figure 2:
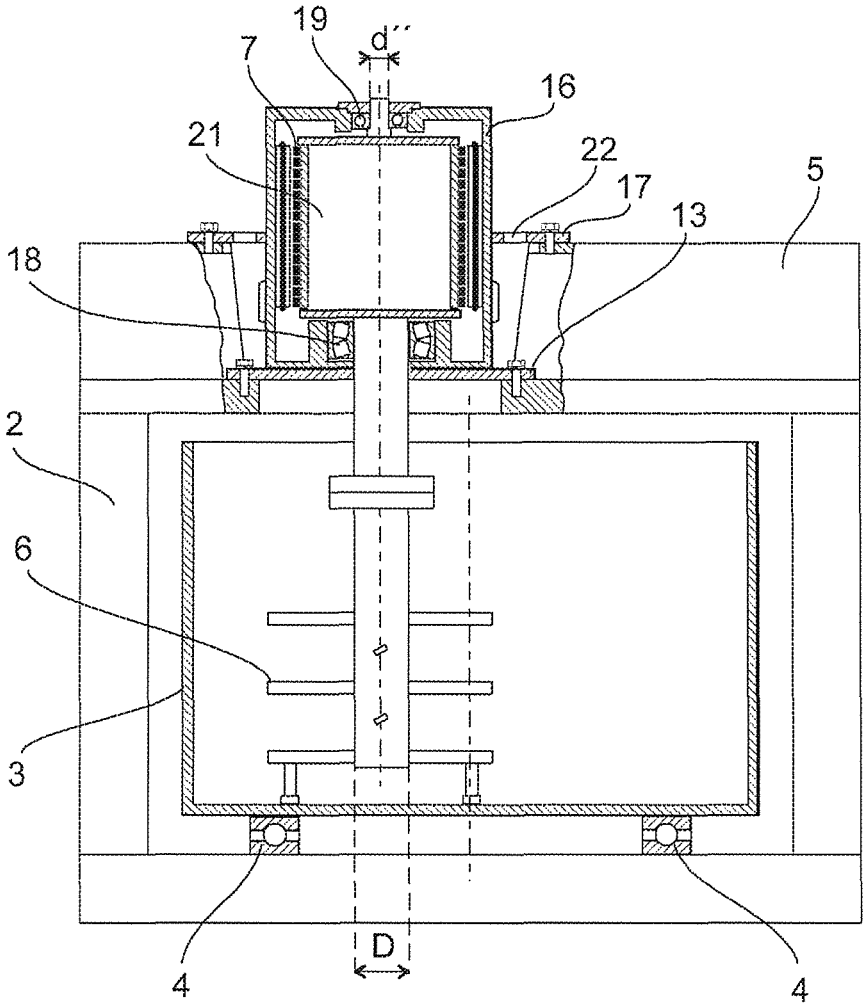
FIG. 2 is a vertical section through a first embodiment according to the invention.

FIG. 2 shows a first embodiment according to the invention. Where possible, the same reference numerals have been selected for the same parts of the mixer that have already been shown in FIG. 1 and discussed. In FIG. 2 the drive motor 7 is received in a motor housing 16, the motor housing 16 being fastened to the mixer cover 5 by means of two outer flanges 13, 17. It may be seen that the tool shaft 8 functions at its drive end at the same time as the motor shaft 21. The motor shaft 21, which in the embodiment shown is embodied partly as a hollow shaft, is held by the self-aligning roller bearing 18 and also the radial bearing 19. The second outer flange 13, which is more faced toward the product space, i.e. the mixing container, has a smaller external diameter than the first outer flange 17. As a result, the entire motor can be inserted into the housing cover 5 from the outside, so that first the outer flange having the smaller external diameter is inserted into a correspondingly stepped hole in the container cover until it rests against the bottom of the extended hole. The spacing of the two outer flanges 13, 17 is designed in such a way that, in the situation shown in FIG. 2, both flanges can be screwed to the housing cover 5.

If required, the motor can thus easily be detached from the housing cover and removed.

Figure 3:
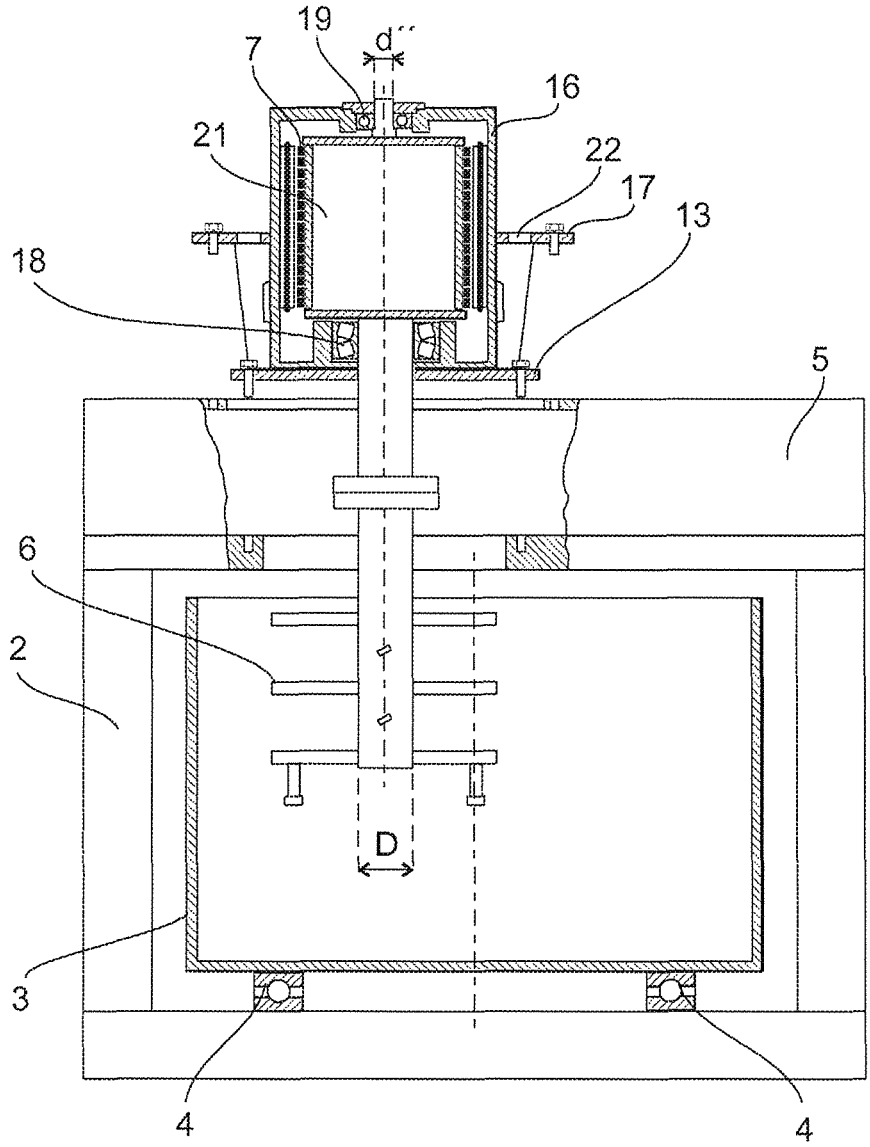
FIG. 3 is a vertical section through a second embodiment according to the invention.

A situation of this type is shown in FIG. 3 which at the same time shows a second embodiment according to the invention of the mixer. In this case, the motor, along with the working tool 6, has been detached from the housing cover 5, so that the motor, along with the working tool 6, can be removed from the corresponding opening in the container cover. The embodiment shown in FIG. 3 differs from the embodiment shown in FIG. 2 in that the flange connection 10 is missing, so that in this case the tool shaft and motor shaft are formed in one piece. In both embodiments shown, the axis of rotation of the working tool is arranged eccentrically to the axis of rotation of the mixing container.

The integration of the motor into a robust bearing unit for accommodating the forces and moments of the working tool produces a unit having minimal maintenance costs and the highest possible reliability. Only one shaft is guided in two bearings. This shaft takes over both the forces of the motor (for example weight forces, magnetic residual forces) and the forces of the working tool (vortexer, kneader, etc.). Any necessary variation of the rotational speed may be facilitated by the use of a frequency converter.

LIST OF REFERENCE NUMERALS

1 Mixer
2 Mixer housing
3 Mixing container
4 Ball bearing
5 Housing cover
6 Working tool
7 Drive motor
8 Tool shaft
9 V-belt
10 Flange connection
11, 12 Tool bearing
13 Flange
14, 15 Motor bearing
16 Motor housing
17 Flange
18 Self-aligning roller bearing
19 Radial bearing
20, 21 Motor shaft
22 Opening for assembly tool

The invention claimed is:

1. A mixer with a mixing container and a tool shaft (8) arranged at least partly in the mixing container, the tool shaft having a working end to which a working tool (6) is fastened or can be fastened and a drive end which is mounted by means of two mutually set-apart tool bearings, a drive motor (7) being provided with a motor shaft (21) for driving the tool shaft (8), wherein the motor shaft (21) is mounted by at least one of the two mutually set-apart tool bearings, and wherein one of the bearings, is a combined radial axial bearing (radiax bearing) (19).

2. The mixer according to claim 1, wherein the motor is arranged between the two tool bearings and the motor shaft (21) is mounted by means of the two tool bearings, so that the tool shaft also serves as the motor shaft.

3. The mixer according to claim 1 or 2, wherein the motor is a direct drive, three-phase synchronous motor.

4. The mixer according to claim 2, wherein the diameter of the motor shaft (21) differs on the two tool bearings.

5. The mixer according to one of claims 1 to 2, wherein the motor is arranged in a motor housing (16), both tool bearings being arranged on or in the motor housing (16).

6. The mixer according to claim 5, wherein the motor housing (16) has a first outer flange (13) and the mixer has a mixer housing (2) in which the mixing container (3) is arranged, the outer flange being fastened to the mixer housing.

7. The mixer according to claim 6, wherein the motor housing (16) has a second outer flange (17) which is also fastened to the mixer housing, the second outer flange (17) having a larger average diameter than the first outer flange (13).

8. The mixer according to claim 7, wherein the mixer housing has a stepped through-opening with a first portion having a smaller average diameter and a second portion having a larger average diameter, the second portion having an average diameter which is larger than the average diameter of the first outer flange (13) and is smaller than the average diameter of the second outer flange (17).

9. The mixer according to claim 8, wherein said first portion of said stepped through-opening has a smallest diameter and the smallest diameter is larger than the largest external diameter of the working tool (6).

10. The mixer according to one of claims 1 to 2, wherein the tool shaft (8) has two portions which are detachably fastened to each other, one of the portions being formed in one piece with the motor shaft (21).

11. The mixer according to one of claims 1 to 2, characterized in that the tool shaft (8) and the motor shaft (21) are formed in one piece.

12. The mixer according to claim 3, wherein the motor is any one of a torque motor, a servo motor and a reluctance motor.

13. The mixer of claim 1, wherein one of the bearings is arranged closer to the working end of the tool shaft.

14. The mixer of claim 4, wherein the two tool bearings include a tool bearing (18) facing the mixing container (3) and a tool bearing (19) remote from the mixing container (3), and wherein the diameter of the motor shaft (21) on the tool bearing remote from the mixing container (3) is the smaller diameter.

15. The mixer of claim 14, wherein the diameter of the motor shaft (21) on the tool bearing (19) remote from the mixing container (3) is at least 30% smaller than the diameter of the motor shaft (21) on the tool bearing (18) facing the mixing container (3).

16. The mixer of claim 14, wherein the diameter of the motor shaft (21) on the tool bearing (19) remote from the mixing container (3) is at least 50% smaller than the diameter of the motor shaft (21) on the tool bearing (18) facing the mixing container (3).

17. The mixer of claim 6, wherein the mixer housing (2) is provided with a housing cover (5), and wherein the outer flange is fastened to the housing cover (5).

18. The mixer of any one of claims 1-2, wherein one of the bearings is a twin-row self-aligning bearing.

19. The mixer of any one of claim 1-2, wherein the combined radial axial bearing is any one of a self-aligning roller bearing and a self-aligning ball bearing.

* * * * *